United States Patent [19]

Hackenberg

[11] Patent Number: 4,959,987

[45] Date of Patent: Oct. 2, 1990

[54] ROLLING MILL STAND WITH MANIPULATOR

[75] Inventor: Wolfgang Hackenberg, Hilchenbach, Fed. Rep. of Germany

[73] Assignee: SMS Schloemann-Siemag Aktiengesellschaft, Dusseldorf, Fed. Rep. of Germany

[21] Appl. No.: 304,366

[22] Filed: Jan. 30, 1989

[30] Foreign Application Priority Data

Jan. 30, 1988 [DE] Fed. Rep. of Germany ..... 3802813

[51] Int. Cl.[5] ..... B21B 31/18

[52] U.S. Cl. ..... 72/247

[58] Field of Search ..... 72/247, 237, 248, 199

[56] References Cited

U.S. PATENT DOCUMENTS

| | | | |
|---|---|---|---|
| 4,154,074 | 5/1979 | Sieurin et al. | 72/247 |
| 4,191,042 | 3/1980 | Salter | 72/247 |
| 4,248,074 | 2/1981 | Fuhrmann et al. | 72/247 |
| 4,589,269 | 5/1986 | Michaux | 72/247 |

FOREIGN PATENT DOCUMENTS

| | | | |
|---|---|---|---|
| 163516 | 9/1983 | Japan | 72/247 |

*Primary Examiner*—Daniel C. Crane

*Attorney, Agent, or Firm*—Toren, McGeady & Associates

[57] ABSTRACT

A rolling mill stand with at least one manipulator for axially moving the rolls, particularly the work rolls, of the rolling mill stand. The rolls are supported and secured in chocks. The chocks are guided in the housings of the rolling mill stand so as to be vertically slidable in the direction of the rolling force. The chocks include pushing blocks which guide horizontally in the direction of the rolling axes. The manipulators supported by the housings act on the pushing blocks from the operator side. The manipulator is connected to the pushing block through a gear arrangement for transmitting the adjusting distance of the manipulator. The gear arrangement operates without slipping.

4 Claims, 2 Drawing Sheets

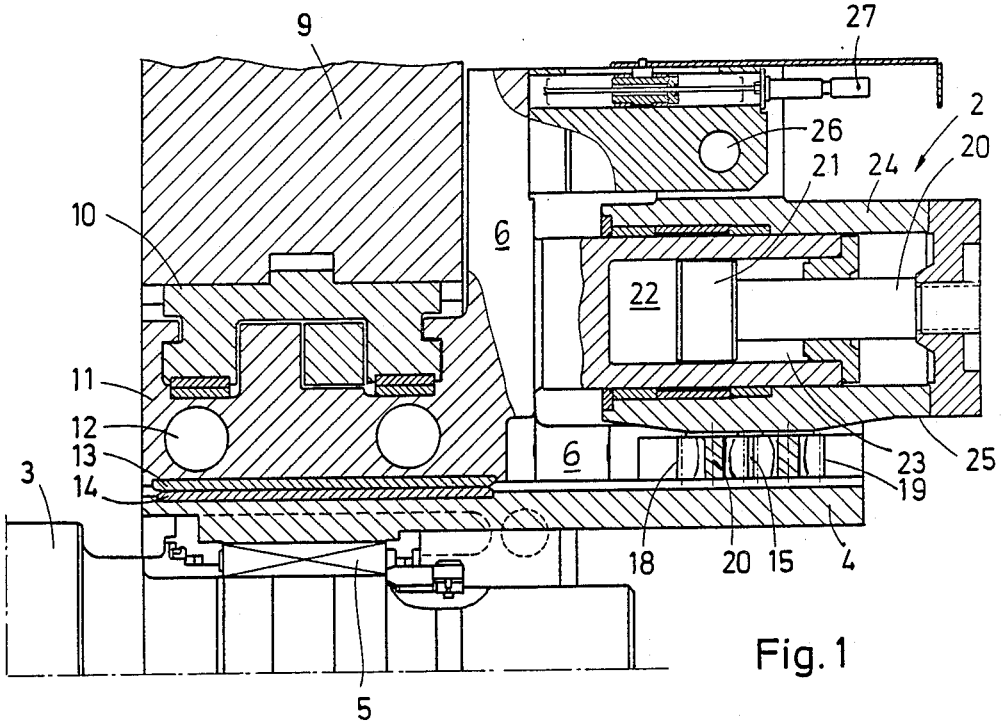
Fig. 1
Fig. 2
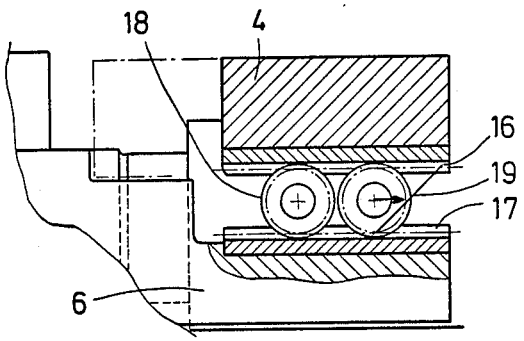

ROLLING MILL STAND WITH MANIPULATOR

BACKGROUND OF THE INVENTION

1. Field of the Invention

The present invention relates to a rolling mill stand with at least one manipulator for axially moving the rolls, particularly the work rolls. The rolls are supported and secured in chocks The chocks are guided in the housings of the rolling mill stand so as to be vertically slidable in the direction of the rolling force. The chocks include pushing blocks which guide horizontally in the direction of the roll axes. The manipulators act on the pushing blocks from the operator side.

2. Description of the Related Art

For improving the planeness of the material to be rolled and for a better thickness constancy over the width of the material to be rolled, it is known in the art to slidably support the rolls in the rolling mill stand. For this purpose, adjusting devices are arranged on the so-called operator side of the rolling mill stand. The adjusting devices serve to slide the rolls in horizontal direction. Recent demands made of the quality of the material to be rolled has resulted in displacement distances of increasing length.

German Offenlegungsschrift 24 40 495 discloses a rolling mill stand which includes two work rolls, two intermediate rolls and two back-up rolls as well as a device for the axial displacement of the intermediate roll. In this rolling mill stand, the rolls are supported in chocks. The chocks are mounted in the rolling mill stand housings so as to be slidable in the direction of the rolling force. The intermediate rolls can be axially displaced together with the chocks by means of hydraulic piston-cylinder units which act in the direction of the roll axis. Two axially outwardly projecting arms are provided on one of the chocks of each intermediate roll. The extendable portion of each pistoncylinder unit acts through a connecting member on each of these arms. The two piston-cylinder units are arranged in the rolling mill stand housings laterally next to the respective chock.

This known construction of a manipulator for the rolls of a rolling mill stand enables, if at all, only small displacement distances because large displacements of the rolls would require correspondingly large strokes of the hydraulically acting piston-cylinder. unit. This results in the disadvantage that adjusting cylinders of corresponding lengths project into the operator side of the rolling mill stand and reduce the space available for the required exchanges and maintenance of the roll. As a result, the set of rolls would have to be pulled out very far during an exchange of rolls, for example, during sideshifting. This, in turn, would lead to long cylinders for pulling out the rolls or would even require the use of expensive, complicated telescopic cylinders.

It is, therefore, the primary object of the present invention to provide a manipulator for rolls in a rolling mill stand which manipulator is of compact construction and still permits large displacement distances of the rolls and does not disadvantageously reduce the space on the operator side of the rolling mill stand.

SUMMARY OF THE INVENTION

In accordance with the present invention, the manipulator is connected to the pushing block through a gear arrangement for transmitting the adjusting distance of the manipulator. The gear arrangement preferably operates without slipping.

The construction in accordance with the present invention makes it possible to reduce, if necessary several times, the adjusting distances of the manipulators while simultaneously obtaining a large predetermined displacement distance of the work roll. As a result, the manipulator may be of extremely compact construction, so that the space on the operator side of the rolling mill stand be utilized to the previously necessary extent, for example, for a quick exchange of the rolls.

In accordance with a further development of the invention, the pushing block and the chock each have at least one rack, wherein the racks of the pushing block and the chock are arranged opposite each other. Between the racks is arranged at least one pinion which is in engagement with the racks. The axle of the pinion is connected to the manipulator.

As a result of the arrangement of racks and pinion according to this feature, the displacement distances of the manipulator are reduced by half and the adjusting forces are reduced by half. Also, an additional locking of the manipulator or of the chock is not required, except during the exchange of rolls, since the teeth of the racks are always in engagement with the teeth of the pinion.

In accordance with another feature of the invention, the manipulator is connected to the chock which receives the horizontally movable pushing block. Accordingly, it is ensured that the manipulator cannot carry out relative movement in the vertical direction relative to the chock. Thus, pinion and racks always remain in an optimum loadbearing engagement, even if the rolls have been reduced to a smaller diameter due to wear during operation. Thus, the adjusting forces of the manipulator are transmitted by the gear assembly composed of racks and pinion in the desired manner to the pushing block and, thus, to the rolls.

In accordance with another further development of the invention, the manipulator includes a double-acting pistoncylinder unit of the known type, wherein the reversibly movable piston shaft is connected to a pushing sleeve which supports the pinion.

As a result of this arrangement, the piston is fastened to a slidable sleeve which, in turn, advantageously carries on the sides thereof a pair of gear wheels. These gear wheels mesh with a rack which is fastened to the chock in a stationary manner, on the one hand, and mesh with the rack mounted on the pushing block, on the other. If the hydraulic piston and, thus, the pushing sleeve are moved back and forth, the pair of gear wheels are rotated and simultaneously subjected to a horizontal relative movement by the pushing sleeves. This results in double the moving distance of the hydraulic piston.

The pushing sleeve of the manipulator advantageously slidingly surrounds the piston-cylinder unit, so that the piston-cylinder unit continuously acts as a guide unit for the pushing sleeve. The pinions are advantageously supported on the outer surface of the pushing sleeve. The pinion can be mounted in a cantilevered manner, with each pinion being placed on a bearing pin separately arranged on the pushing sleeve. The pinions can also be mounted in a bearing block which surrounds the two pinions and is connected to the pushing sleeve.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

FIG. 1 is a partial sectional top view of a rolling mill stand with a roll supported in a chock and a manipulator arranged on the operator side;

FIG. 2 is a partial sectional side view of a detail of the pinion arrangement between chocks and pushing block.

DESCRIPTION OF THE PREFERRED EMBODIMENT

Figure 4:
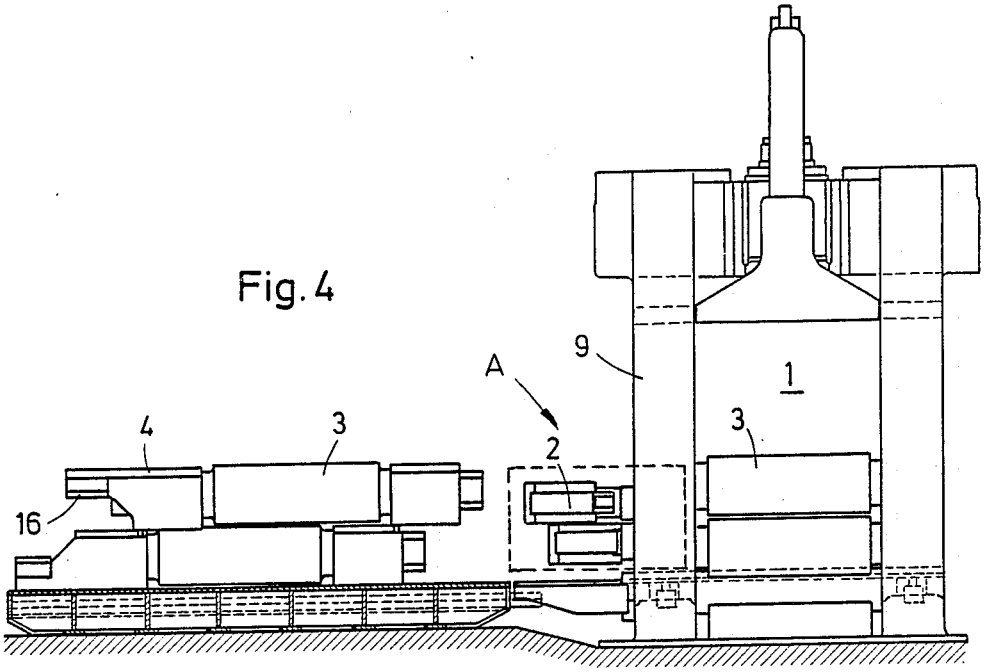
FIG. 4 is a schematical illustration of the rolling mill stand with the work rolls being removed.
Figure 3:
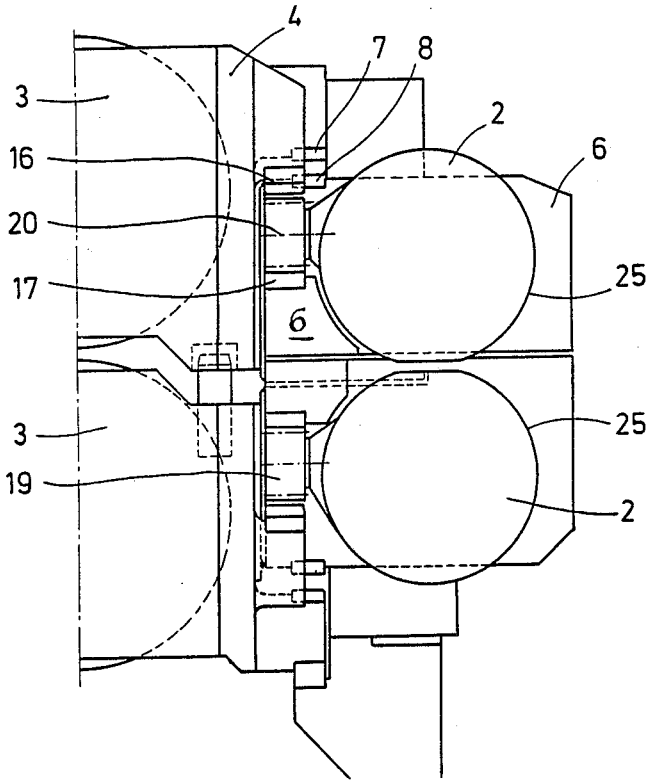
FIG. 3 is a side view of the manipulator on the operator side of the rolling mill stand, the work rolls being in the exchanging position.

FIG. 1 of the drawing shows a detail A of a rolling mill stand 1 schematically illustrated in FIG. 4. The rolling mill stand 4 includes a manipulator 2 for displacing the work roll 3. The work roll 3 is radially supported and axially secured in a pushing block 4 by means of bearing 5. The pushing block 4 is connected to the chock 6 so as to be horizontally slidable. The sliding guidance between the pushing block 4 and the chock 6 is effected by means of sliding rails 7, 8 which are arranged opposite each other on the pushing block 4 and the chock 6, respectively, as can be seen in FIG. 3. The sliding rails 7, 8 serve to absorb the vertically acting load and rolling forces.

As shown in FIG. 1, the chock 6 is vertically guided in the direction of the rolling force and is horizontally secured in the rolling mill stand 9 by means of the guide block 10 which serves to positively connect the rolling mill stand housing 9 and the chock 6 with each other. The chock 6 includes a bending block 11 in which are arranged bending rods 12 for balancing and bending the rolls. The bending rods 12 are actuated, for example, by a pressure medium. Additional sliding or wear bars 13, 14, for example, of bronze-containing materials, are arranged on the bending block 11 on the vertical contact surface facing the pushing block 4. The chock 6 is extended toward the operator side of the rolling mill stand 1 and supports the manipulator 2, so that the manipulator and the chock receiving the horizontally slidable pushing block 4 form a solid unit. The manipulator 2 is connected to the pushing block 4 through a gear arrangement 15 for transmitting the displacement distance of the manipulator. The gear arrangement 15 preferably acts without slipping.

FIGS. 2 and 3 of the drawing show that the pushing block 4 and the chock 6 including bending blocks 11 each have a rack 16, 17, and that two pinions 18, 19 are arranged which are in engagement with the racks 17. The axis 20 of the pinion is in connection with the manipulator 2.

As shown in FIG. 1, the manipulator 2 includes a pistoncylinder unit 21 of the known type. The movement of the piston shaft 22 of unit 21 is reversible because pressure medium of any selected type can be admitted to the cylinder spaces 22, 23. The piston shaft is connected to a pushing sleeve 34. The pinions 18, 19 are mounted in a cantilevered manner on the outer surface 25 of the pushing sleeve 24. For effecting a sliding guidance, the pushing sleeve 24 surrounds the piston-cylinder unit 21 and is secured against rotation by means of a securing bolt 26. The pushing sleeve further includes a distance measuring system 27.

When a pressure medium is admitted to the cylinder space 22 of the piston-cylinder unit 21, the piston shafts 20 and, thus, the pushing sleeves 24 are moved toward the operator side. During the movement of the pushing sleeve, the pinions 18, 19 rest on the rack 17 which is fixedly mounted on the the chock 6 and simultaneously rotate about the pinion axes 20 which are horizontally moved by the pushing sleeve 24.

Because of the engagement of the teeth of the pinions 18, 19 with the rack 16 arranged on the horizontally movable pushing block 4, the pushing block 4 is subjected to a displacement distance which is double the displacement effected by means of the manipulator 2. The permanent engagement of the racks 16, 17 with the pinions 18, 19 secures the pushing block against any further unintentional horizontal displacement. Thus, the non-slip gear arrangement composed of pinions and racks between the manipulator and the pushing block results in a transmission of the displacement distance of the manipulator, on the one hand, and simultaneously secures the predetermined position of the work roll mounted in the pushing block, on the other.

While a specific embodiment of the invention has been shown and described in detail to illustrate the application of the invention principles, it will be understood that the invention may be embodied otherwise without departing from such principles.

I claim:

1. In a rolling mill stand with at least one manipulator for axially moving rolls of the rolling mill stand, the rolling mill stand including housings and chocks guided in the housings so as to be vertically slidable in the direction of the rolling force, the rolls of the rolling mill stand being supported and secured in the chocks, the rolls having axes, the chocks including pushing blocks for effecting horizontal guidance in the direction of the roll axes, the rolling mill stand having an operator side, the manipulators acting on the pushing blocks from the operator side, the improvement comprising the manipulator being connected to the pushing block through a non-slip gear arrangement for transmitting an adjusting distance of the manipulator, wherein each pushing block and each chock have each at least one rack, wherein the rack of the pushing block and the rack of the chock are arranged opposite each other, at least one pinion having an axle being arranged between and in engagement with the racks, the axle of the pinion being connected to the manipulator.

2. The rolling mill stand according to claim 1, wherein the manipulator is connected to the chock which receives the horizontally movable pushing block.

3. The rolling mill stand according to claim 1, wherein the manipulator comprises a double-acting piston-cylinder unit, the piston-cylinder unit including a reversibly movable piston shaft, the at least one pinion being mounted on a pushing sleeve, the piston shaft being connected to the pushing sleeve.

4. The rolling mill stand according to claim 3, wherein the pushing sleeve of the manipulator is mounted so as to slidingly surround the piston-cylinder unit, the pushing sleeve having an outer surface, the at least one pinion being supported on the outer surface of the pushing sleeve.

* * * * *